United States Patent [19]

Dalquist, III et al.

[11] Patent Number: 4,746,781

[45] Date of Patent: May 24, 1988

[54] PORTABLE TURNTABLE FOR USE IN MICROWAVE OVENS AND HAVING A MOVABLE DETENT FOR SELECTIVELY ALLOWING AND PREVENTING TURNTABLE ROTATION

[75] Inventors: H. David Dalquist, III, Minnetonka; Lloyd G. Keleny, Champlin; Jorgen A. Jorgensen, Bloomington; Douglas J. Kluge, Golden Valley, all of Minn.

[73] Assignee: Northland Aluminum Products, Inc., Minneapolis, Minn.

[21] Appl. No.: 68,577

[22] Filed: Jul. 1, 1987

[51] Int. Cl.[4] ..... H05B 6/78

[52] U.S. Cl. ..... 219/10.55 F; 219/10.55 E; 108/20; 108/142; 99/443 R; 126/338

[58] Field of Search ..... 219/10.55 F, 10.55 E, 219/10.55 R, 389; 99/448, 423, 443 R; 126/338; 108/20, 139, 142

[56] References Cited

U.S. PATENT DOCUMENTS 4,456,805 6/1984 Jorgensen et al. ..... 219/10.55 F
4,625,087 11/1986 Jorgensen et al. ..... 219/10.55 F
4,629,846 12/1986 Dilyard ..... 219/10.55 F
4,636,605 1/1987 Berend et al. ..... 219/10.55 F

*Primary Examiner*—Philip H. Leung
*Attorney, Agent, or Firm*—Orrin M. Haugen; Thomas J. Nikolai; Frederick W. Niebuhr

[57] ABSTRACT

A device for rotating food while cooked in a microwave oven includes a metal housing supported above the oven floor by dielectric feet, and a turntable mounted above the housing. The turntable is rotatable by virtue of a turntable shaft having downwardly extended legs forming a non-circular cross-section, insertable into a similarly configured bore within a drive shaft inside the housing. A detent, pivotally mounted beneath the housing, can be pivoted manually to a locking position in which an arm of the detent engages one of several notches formed in the turntable, to prevent further turntable rotation relative to the housing. A bearing assembly between the top of the housing and the turntable includes an annular frame, and a plurality of ball bearing-containing receptacles arranged symmetrically about the frame.

15 Claims, 2 Drawing Sheets

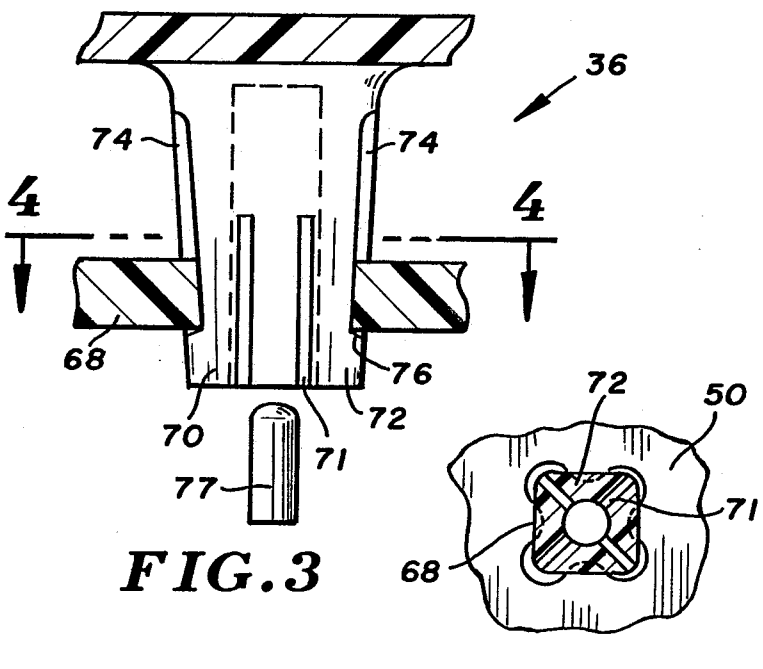
FIG. 3
FIG. 4
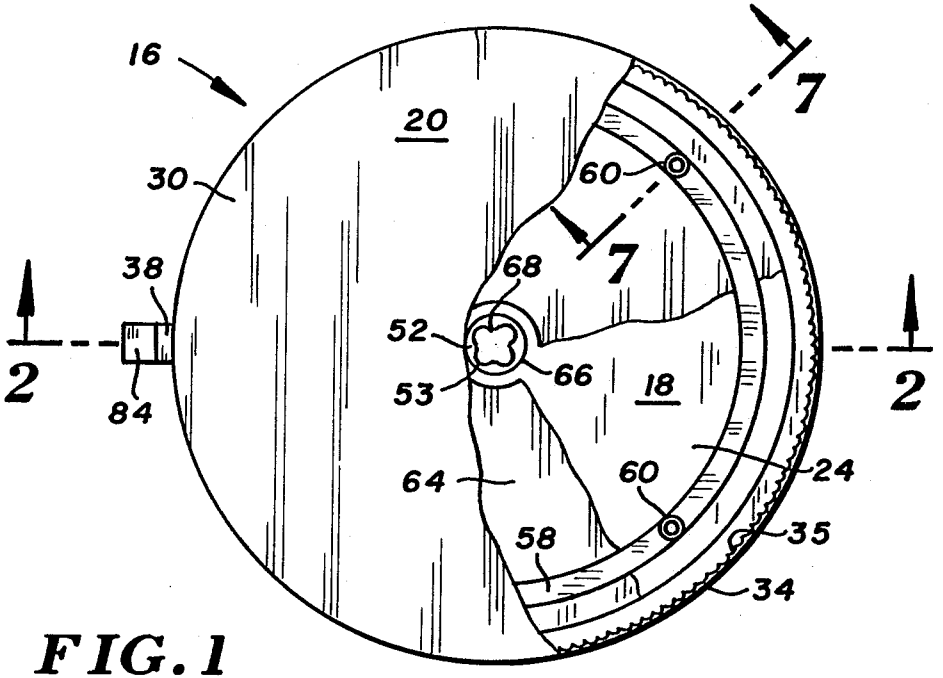
FIG. 1
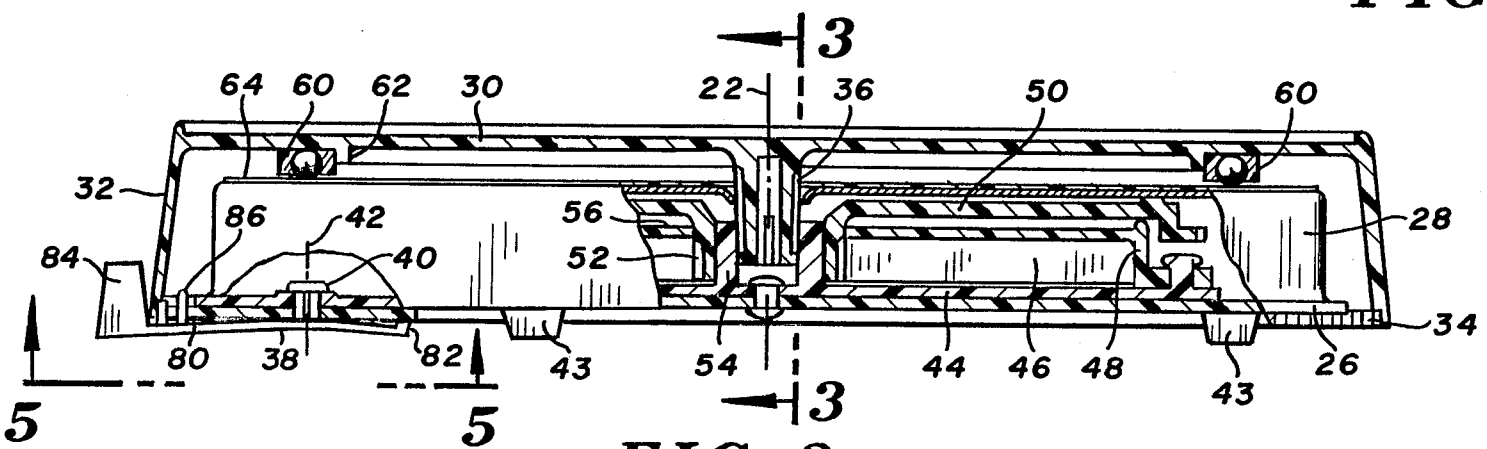
FIG. 2

PORTABLE TURNTABLE FOR USE IN MICROWAVE OVENS AND HAVING A MOVABLE DETENT FOR SELECTIVELY ALLOWING AND PREVENTING TURNTABLE ROTATION

BACKGROUND OF THE INVENTION

This invention relates to apparatus for cooking food, and more particularly to a turntable for rotating food as it is cooked in a microwave oven.

It is well known that in the majority of microwave ovens, the distribution of microwave energy is not uniform throughout the microwave oven enclosure. As a result, "hot spots" can develop in food as it is cooked in a microwave oven, while other portions of the food may not be adequately cooked. To avoid this problem, turntables for rotating food have been built into microwave ovens. Alternatively, portable turntables have been constructed for use in such ovens. For example, U.S. Pat. No. 4,625,087 to Jorgensen et al. granted Nov. 25, 1986 and assigned to the assignee of this application, shows a low profile turntable with a dielectric base, a dielectric turntable over the base, and a plurality of ball bearings between the cover and base for permitting the turntable to rotate relative to the base. Between the turntable and base is an enclosed metal housing, with a spring motor inside the housing to drive the turntable. A plurality of prongs, insertable through openings in the cover, are positioned to engage notches formed in a ledge of the base, thus to prevent the turntable from rotating with respect to the base, particularly when there is no food carried by the turntable.

While the turntable featured in U.S. Pat. No. 4,625,087 has enjoyed substantial commercial success, efforts were undertaken to improve the turntable design in a number of respects, the emphasis being to provide a simpler, lower cost turntable of smaller size.

Consistent with these efforts, it is an object of the present invention to provide a food rotating device suitable for use in microwave ovens, simple in design and assembled at reduced cost.

Another object of the invention is to provide a positive acting, manually actuable detent switch for selectively locking and releasing the turntable of a food rotating device.

Another object of the invention is to provide an improved means for connecting the turntable of a microwave oven food rotating device with respect to a mechanism in the device for driving the turntable.

Yet another object of the invention is to provide a bearing assembly utilizing metallic ball bearings between a stationary metallic housing of a food rotating device, and a turntable rotating with respect to the housing.

SUMMARY OF THE INVENTION

To achieve these and other objects, there is provided an apparatus for supporting and rotating food as it is cooked, having a substantially enclosed housing. A turntable including a circular, substantially planar and horizontal platform is provided for supporting food, and a turntable shaft of a non-circular horizontal cross-section projects substantially downwardly from the center of the platform. A turntable drive means in the housing has a rotatable drive shaft. A bore of non-circular horizontal cross-section is formed in the drive shaft and conforms to the horizontal cross-section of the turntable shaft. The turntable shaft projects through an opening in the housing to engage the drive shaft at the bore for rotation with the drive shaft, thus rotating the turntable, in a first direction relative to the housing, about a vertical drive axis at the center of the turntable. A detent member is mounted with respect to the housing for movement generally in the first direction to a first position, and in a second and opposite direction away from the first position. An end portion of the detent member is positioned to engage the turntable whenever the detent member is at least proximate said first position. Any turntable rotation after such engagement tends to move the detent member to the first position. The detent member further has a projection positioned to contact the housing substantially as the detent member is moved into the first position. This prevents movement of the detent member generally in said first direction beyond the first position, thus to prevent further rotation of the turntable.

Preferably the detent member includes an elongate lever pivotally mounted to the bottom of the housing and extending generally horizontally and radially outward beyond the housing perimeter. The detent member also can have an elongate arm extended from the lever. The turntable can include an annular turntable wall projected generally downward from the perimeter of the platform. A plurality of substantially uniform notches then are formed in a lower inside edge of the turntable wall. The free end of the arm, which extends beyond the housing perimeter, engages one of the notches when the detent member is at least proximate the first position.

One feature of the present invention resides in the fact that the detent member, to reach its first or turntable locking position, is pivoted in the same direction as the turntable rotates relative to the housing. As a result, whenever the detent member is at least close to its retaining position, continued turntable movement tends to drive the detent member firmly into the locking position. At that point, the end portion of the arm abuts the housing to prevent any further movement of the detent member in the first direction, thus to prevent further movement of the turntable. Consequently, the user is able to stop turntable rotation without completely or precisely positioning the detent member in its locking position.

The drive means advantageously includes a coiled spring with one end fixed relative to the housing, and a gear having a central shaft comprising the drive shaft adapted to engage a second end of the coil spring, thus to drivingly associate the gear and housing. The turntable shaft can terminate with a plurality of downwardly directed, flexible legs spaced angularly from one another, with a depression formed in a radially outward surface of each leg. The bore in the drive shaft then is provided with radially inwardly directed protrusions, one protrusion associated with each leg and having a contour conforming to the contour of its associated depression. This arrangement affords a secure, positive snap fit of the turntable shaft into the drive shaft for securing the turntable to the housing, and is accomplished conveniently simply by pressing the turntable shaft into the bore.

Another feature of the present invention is an apparatus for supporting and rotating food in an oven. The apparatus includes a substantially enclosed housing with substantially flat and horizontal upper and lower panels, and a substantially upright and annular housing perimeter wall joining the upper and lower panels. The apparatus further includes a turntable with a substantially planar and horizontal platform, an annular turntable wall projected generally downward from the perimeter of the platform, and a turntable shaft at the center of the turntable projected downwardly from the platform and into the housing through an opening in the upper panel. A drive means is contained in the housing for engaging the turntable shaft to rotate the turntable about a vertical drive axis with respect to the housing. A bearing assembly is provided between the platform and upper panel for supporting the platform as it rotates. The assembly includes an annular frame, a plurality of ball bearing receptacles integral with the frame and arranged angularly about the frame, and a bearing compartment in each receptacle. Each compartment is symmetrical about a vertical compartment axis and includes a top portion with a diameter less than the diameter of an associated ball bearing contained in the compartment. The remainder of each compartment has a diameter greater than the diameter of the ball bearing. A plurality of bearing retaining nodules are angularly arranged about the bottom of each compartment and extend radially inward. The nodules normally prevent passage of the ball bearing into and out of the compartment, but are elastically compressible to admit the ball bearing into and release the ball bearing from the compartment.

In a construction particularly well suited for microwave ovens, the housing is metal and supported in spaced apart relation to the floor of a microwave oven by a plurality of dielectric feet. A plastic disc, having a diameter greater than the outside diameter of the annular frame, is positioned between the bearing assembly and the housing, and the bearings are constructed of metal. The plastic disc electrically isolates the metallic bearings from the housing to facilitate their use in the microwave oven environment. Further, the bearings are contained in the compartments at a desired angular spacing from one another, and self-contained to reduce the cost of assembling the food rotator.

IN THE DRAWINGS

The above and other features and advantages will become apparent upon consideration of the detailed description of the preferred embodiment in connection with the accompanying drawings, in which:

FIG. 1 is a top view of a food rotating device constructed in accordance with the present invention, with parts of the device cut away to facilitate illustration of certain features;

FIG. 2 is a sectional view taken along the line 2—2 in FIG. 1;

FIG. 3 is a sectional view taken along the line 3—3 in FIG. 2;

FIG. 4 is a sectional view taken along the line 4—4 in FIG. 3;

DETAILED DESCRIPTION OF THE PREFERRED EMBODIMENT

Figure 5:
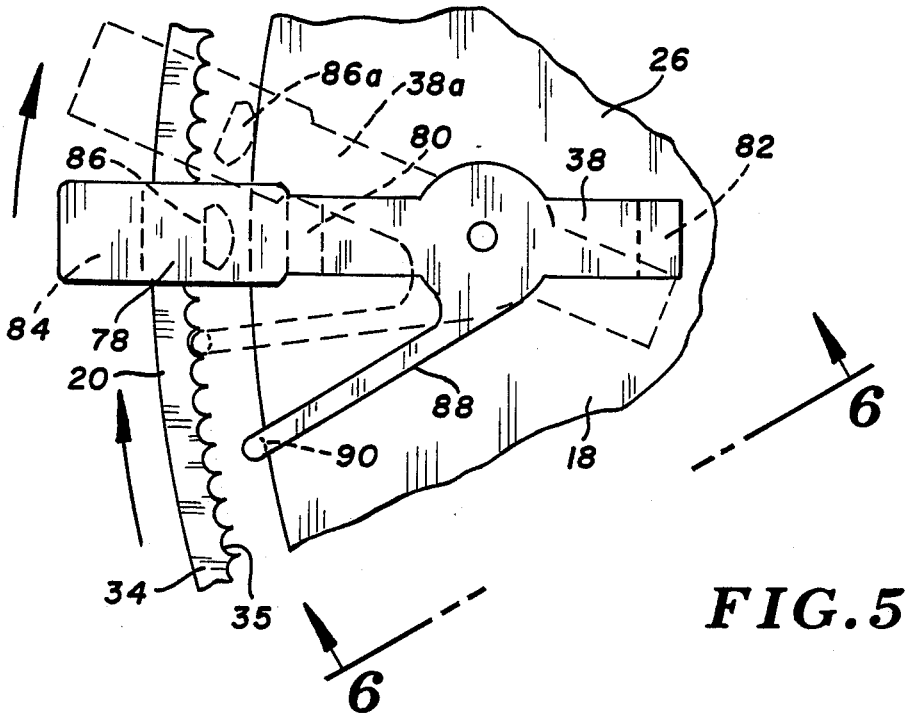
FIG. 5 is a partial bottom view of the device taken along the line 5—5, in FIG. 2.

Turning now to the drawings, there is shown in FIGS. 1 and 2 a food rotating device 16 constructed in accordance with the present invention and including a substantially enclosed metallic housing 18, and a turntable 20 mounted above housing 18 to rotate with respect to the housing about a central drive axis 22.

Housing 18 includes a planar and horizontal upper panel 24, a planar and horizontal lower panel 26, and an annular housing perimeter wall 28 joining the top and bottom panels. Preferably, upper panel 24 and perimeter wall 28 are formed as a single member, and attached to bottom panel 26 by crimping to substantially enclose the housing.

Turntable 20 preferably is constructed of a durable dielectric material, somewhat flexible yet affording a hard, smooth surface finish, for example polycarbonate. The turntable is formed as a unitary casting or molding, and includes a flat and horizontal platform 30 for supporting a food item (not shown) as it is cooked. An annular turntable wall 32 projects generally downward from the platform but is inclined slightly radially outwardly in the downward direction, terminating in a lower edge portion or rim 34. Formed along the inside surface of rim 34 are a series of substantially uniform notches 35, adjacent one another and extending over the entire perimeter of turntable wall 32. A centrally located turntable shaft 36 projects vertically downward from the platform.

A detent or locking member 38 is pivotally mounted to lower panel 26 through a plurality of elastic locking fingers 40 extended through a circular opening in the lower panel. As fingers 40 cooperate to define a cylinder, detent 38 is free to pivot on a vertical pivot axis 42 with respect to housing 18. As fingers 40 are inserted through the opening they are bent inwardly to permit passage of the enlarged tip at the upper end of each finger. Three elastic, dielectric feet 43 are inserted into openings angularly spaced apart 120° along the periphery of lower panel 26, and support housing 18 in spaced apart relation to a microwave oven floor. Alternatively, feet 43 could be metal, formed integrally with lower panel 26.

Inside housing 18 is an internal gear train base 44 of plastic, permanently attached to lower panel 26. A spring motor 46, comprising a strip of metal wound in a spiral or coil, is contained within a casing 48, with its radially outward end fixed to an upright wall of casing 48. Also mounted within housing 18 and forming part of the turntable drive means is a main drive gear 50 having a central drive shaft 52 projected downwardly into casing 48 through an opening in the top of the casing. A vertical bore 53 is formed through the center of drive shaft 52, and includes an enlarged cylindrical lower portion conforming to the outside diameter of a tubular upright portion 54 of gear train base 44, permitting drive gear 50 to rotate about drive axis 22 relative to the housing. Drive shaft 52 engages the radially inward end of spring motor 46. The manner in which the spring motor is wound and then drives gear 50, and further details of the drive mechanism, are disclosed in U.S. Pat. No. 4,625,087, incorporated herein by reference.

The upper portion 56 of bore 53 is non-circular in horizontal cross-section, and conforms to a non-circular horizontal cross-section of turntable shaft 36, whereby the turntable shaft nests in bore 53 and is angularly fixed, to rotate whenever drive gear 50 rotates.

To accommodate the relative rotation between turntable 20 and housing 18, a bearing assembly is provided between upper panel 24 and the underside of platform 30. The bearing assembly includes an annular frame 58, and four substantially identical ball bearing receptacles 60 integral with frame 58 and angularly distributed about the frame, with each receptacle 90° from its adjacent receptacles. The frame and receptacles preferably are a unitary member formed of a dielectric material such as polycarbonate. As best seen in FIG. 2, an annular ridge 62 projects downwardly from platform 30, thus to position and maintain frame 58 centered on drive axis 22.

Lying upon upper panel 24, between the panel and frame 58, is a flat and flexible disc 64, preferably of Mylar or similar dielectric material, with a central opening to accommodate turntable shaft 36. The diameter of disc 64 can be approximately the same as the diameter of housing 18, but should at least exceed the outer diameter of annular frame 58, in order to provide a dielectric spacing between the annular frame and panel 24. As a result, the bearing assembly can employ steel bearings. With the bearings interacting with disc 64, noise is kept to a minimum. Also, disc 64 protects panel 24 against damage from the bearings. Finally, disc 64 electrically isolates the bearings from upper panel 24, to positively ensure against arcing between a ball bearing and panel 24 that might otherwise occur in a microwave oven.

A portion of drive shaft 52 is visible through an opening 66 in the center of upper panel 24, and reveals the upper, noncircular cross-sectional portion of bore 53. The upper portion of the bore resembles a square in cross-section, but with four protrusions 68, each directed radially inward and spaced angularly 90° from its adjacent protrusions.

Turntable shaft 36 is shown in greater detail in FIGS. 3 and 4. Shaft 36 is generally square in horizontal cross-section, and is provided at its lower end with four substantially identical downwardly depending legs 70. Each leg 70 is separated from its adjacent legs by a radial gap 71 running longitudinally of the legs, whereby each leg is elastically bendable to displace its bottom end portion 72 radially inward. A depression 74 is formed in the radially outward facing surface of each leg 70. Each depression is generally rounded, except for a generally horizontal edge 76 at the bottom of the depression. Furthermore, the contour of each depression conforms to the curvature of each protrusion 68, producing a snug fit of turntable shaft 36 within the upper portion of bore 53, with each edge 76 capturing the bottom of its associated protrusion 68.

As a consequence of this arrangement, turntable 20 can be mounted with respect to housing 18 simply by aligning turntable shaft 36 with bore 53 and pushing downwardly upon the turntable. Bottom ends 72 of legs 70 are moved radially inwardly toward one another as the legs elastically bend, with each leg at least partially returning to its normal, unstressed position once edges 76 are moved downwardly beyond protrusions 68 to the configuration shown in FIG. 3. Preferably, legs 70, when contained in the upper portion of bore 53, are under slight elastic compression, to firmly retain the legs in the bore.

In FIG. 5, a switch or detent 38 is shown below housing 18. A blunt tipped, cylindrical wedge pin 77, shown apart from shaft 36, can be inserted between legs 70 to more firmly secure shaft 36 in bore 53 if desired. The detent includes an elongate lever 78 from which locking fingers 40 project vertically upward. Formed in lever 78, on opposite sides of the fingers, are first and second convex raised portions 80 and 82, which cooperate with locking fingers 40 to frictionally secure detent 38 with respect to housing 18, so that detent 38 tends to remain in a selected angular location with respect to the housing. First raised portion 80 further biases the radially outward portion (left as viewed in FIG. 5) of lever 78 slightly downward from the horizontal, to position lever 78 clear of turntable rim 34. The radially outward end of lever 78 is raised as indicated at 84 for user convenience in operating the detent.

Figure 6:
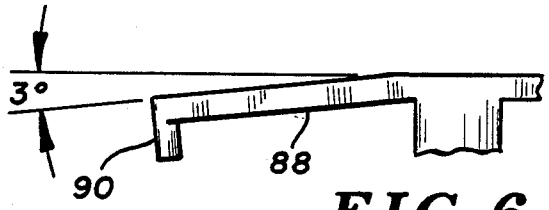
FIG. 6 is an inverted end elevation of a portion of a detent of the food rotating device.

A locking projection 86 is formed on lever 78, and extends upwardly from the lever between the outward end of the lever and raised portion 80. Integral with the lever and extending from a point near locking fingers 40 is an inclined arm 88. As best seen in FIG. 6, a cylindrical end portion or tip 90 extends upwardly from the end of arm 88. If desired, arm 88 can be slightly upwardly inclined (e.g. 3°) relative to lever 78, thus to better align tip 90 with rim 34 of turntable wall 32 and to more firmly retain detent 38 in panel 26. Furthermore, the tip is convex over its radially outward surface, to conform to the curvature of the notches 35 formed in the rim.

The operation of detent 38 is understood from FIG. 5. As indicated by the arrow, turntable 20, when rotated by spring motor 46, moves relative to the housing in the clockwise direction as viewed in the figure, i.e. as viewed from the bottom. Detent 38 is shown in solid lines in a release position, wherein it is free of turntable 20. Broken lines at **38*a* indicate a locking position for the detent member, after the detent has rotated approximately 15° in the clockwise direction from the release position. In the locking position, tip 90 at the free end of arm 88 is engaged with turntable 20, by virtue of its containment within one of notches 35. At the same time, locking projection 86, as indicated at 86*a*, contacts the perimeter of housing 18. The locking projection prevents any further clockwise rotation of detent 38, and at the same time prevents any further clockwise rotation of turntable 20 relative to the housing. Alternatively, locking projection 86 is not used, in which case arm 88** provides the entire lock action.

Thus, detent 38 pivots to its locking position in the same direction as turntable 20 rotates relative to the housing—clockwise as viewed in FIG. 5. As a result, whenever detent 38 is pivoted at least proximate to its locking position, i.e. to the point of initial contact between arm 88 and rim 34, the rim drives the arm, and the remainder of the detent, completely into the locking position. The combination of the slight upward inclination in arm 88, and the tapered outward surface of tip 90, combine to guide the tip into an associated notch, thus to ensure effective locking engagement of the arm and rim.

Detent 38 is freed from its locking position simply by a counterclockwise pivoting as viewed in FIG. 5, which is easily accomplished in moving outer end portion 84 by hand. This releases turntable 20 to rotate in response to the spring motor once again. Clockwise pivoting of lever 78 is limited to a point at which projection 86 contacts housing 18, to prevent severe overtravel of the lever when moved counterclockwise.

Figure 7:
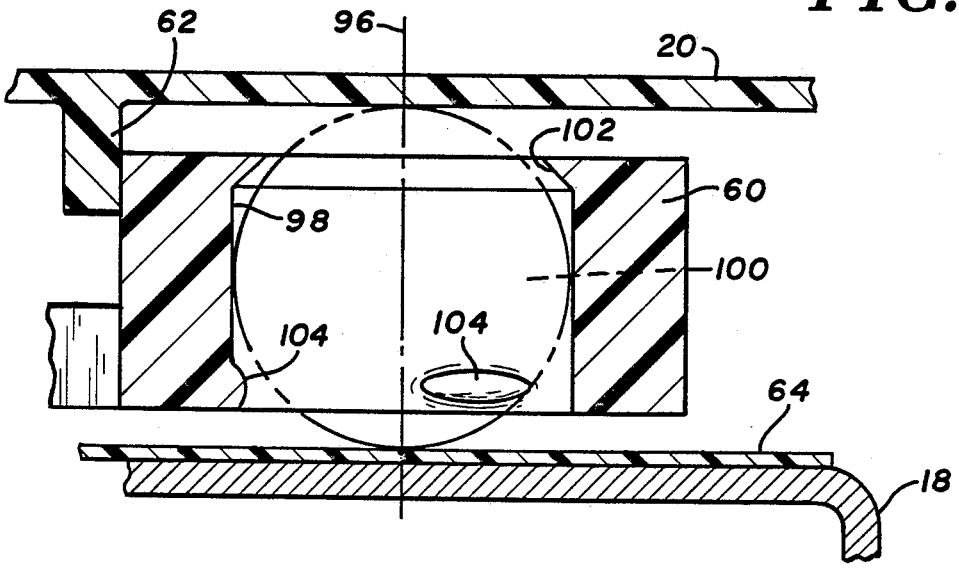
FIG. 7 a sectional view taken along the line 7—7 in FIG. 1.

FIG. 7 shows one of bearing receptacles 60, all four of which are substantially identical in construction. Formed in receptacle 60, and symmetrical about a vertical bearing axis 96, is a generally cylindrical bearing compartment 98. The nominal diameter of bearing compartment 98 is greater than the diameter of a ball bearing 100 housed in the compartment. However, at the top of compartment 98 is an annular, upwardly and radially inwardly inclined bearing retaining surface 102, with a diameter smaller than the bearing diameter.

Securing the bearing at the bottom of compartment 98 are three bearing retaining nodules 104, spaced apart angularly from one another 120°, and projecting radially inward a sufficient distance to normally retain bearing 100 within compartment 98. However, nodules 104 are elastically compressible to release the bearing from the compartment, or to re-admit the bearing into the compartment. Thus, bearings 100 are held securely in their associated receptacles on annular frame 58, facilitating assembly of the food rotating device 16 in that the relatively small bearings need not be individually handled. Furthermore, the arrangement ensures that bearings 100 are evenly distributed about the annular frame, to proportionally bear the weight of the turntable and food. At the same time, the bearings are readily removed for inspection or replaced, if desired.

The openings in housing 18, more particularly opening 66 and the openings to accommodate feet 43 and locking fingers 40, are preferably kept small. In particular, these openings should have a diameter of substantially less than one-fourth of the wavelength normally encountered in the microwave oven, to minimize the possibility of microwave energy entering housing 18.

Thus is disclosed a simple and reliable device suitable for rotating food while cooked in microwave ovens. The detent provides a positive, manually actuable means for preventing turntable rotation when it no longer is needed, which, when moved sufficiently near its locking position, is carried by turntable movement completely into the locking position. The downwardly depending legs forming the lower end portion of the turntable shaft are configured for a convenient snap fit into the drive shaft, for simple and low-cost assembly. The annular bearing frame further reduces assembly cost by eliminating the need to handle individual bearings, and positively ensures proper angular spacing between adjacent bearings.

We claim:

1. An apparatus for supporting and rotating food as it is cooked, including:

a substantially enclosed housing;

a turntable including a circular, substantially planar and horizontal platform for supporting food, and a turntable shaft of a non-circular horizontal cross-section projected substantially downwardly from the center of said platform;

a turntable drive means in said housing having a rotatable drive shaft, and means forming in said drive shaft a bore of non-circular horizontal cross-section conforming to said turntable shaft, wherein said turntable shaft projects through an opening in said housing to engage said drive shaft at said bore for rotation of said turntable, along with said drive shaft, relative to said housing and in a first direction about a vertical drive axis at the center of said turntable; and a detent member mounted with respect to said housing for movement in substantially said first direction to a first position, and in a second and opposite direction away from said first position to a second position; wherein an end portion of said detent member is positined to engage said turntable whenever said detent member is at least proximate said first position, any turntable rotation after such engagement tending to move said detent member to said first position to prevent further rotation of said turntable;

said detent member further having a projection positioned to contact said housing as said detent member is moved in said second direction to prevent movement of said detent member in said second direction beyond said second position.

2. The apparatus of claim 1 wherein:

said projection further is positioned to contact said housing substantially as said detent member is moved into said first position, and thereby prevent movement of said detent member generally in said first direction beyond said first position, thus to prevent further rotation of said turntable.

3. The apparatus of claim 2 wherein:

said housing is constructed of metal, and said apparatus includes a plurality of dielectric feet mounted to said housing near its periphery, for supporting said housing in spaced apart relation to a floor of a microwave oven.

4. The apparatus of claim 2 wherein:

said detent member includes an elongate lever pivotally mounted to said housing and extending generally horizontally and radially outward beyond the housing perimeter, said detent member further including an elongate arm extended from said lever, the free end of said arm extending beyond the housing perimeter and comprising said end portion; and wherein said turntable includes an annular turntable wall projected generally downward from the perimeter of said platform, and means forming a plurality of substantially uniform notches in a lower inside edge of said turntable wall, with the free end of said arm being positioned to engage one of said notches when said detent member is at least proximate said first position.

5. The apparatus of claim 4 wherein:

said lever is mounted beneath said housing, and said projection extends upwardly from said lever at a location beyond the housing perimeter, and contacts said housing perimeter when said lever is pivoted to said first position.

6. The apparatus of claim 5 wherein:

said arm is inclined upwardly with respect to said lever.

7. The apparatus of claim 6 wherein:

said end portion of said arm is enlarged and has an outward edge tapered upwardly and radially inward and generally conforming to each of said notches.

8. The apparatus of claim 7 further including:

a raised portion in said lever positioned against said housing when said lever is pivotally mounted thereto, for biasing said lever in a direction downwardly and radially away from a vertical pivot axis of said lever.

9. The apparatus of claim 2 wherein:

said drive means includes a coiled spring having one end fixed relative to the housing, and a gear having a central shaft comprising said drive shaft, said central shaft adapted to engage a second end of said coil spring to drivingly associate said gear with said housing;

said turntable shaft includes at its lower end portion a plurality of downwardly directed, flexible legs spaced angularly from one another, and means forming a depression in a radially outward surface of each leg; and said bore includes a plurality of radially inwardly directed protrusions, one protrusion associated with each of said legs and having a contour conforming to the contour of its associated depression.

10. An apparatus for supporting and rotating food in an oven, said apparatus including:

a substantially enclosed housing including substantially flat and horizontal upper and lower panels, and a substantially upright, annular housing perimeter wall joining said upper and lower panels;

a turntable including a substantially planar and horizontal platform, and an annular turntable wall projected generally downward from the perimeter of said platform, and a turntable shaft at the center of said turntable and projected downwardly from said platform and into said housing through an opening in said upper panel;

a drive means contained in said housing for engaging said turntable shaft to rotate said turntable about a vertical drive axis with respect to said housing;

a bearing assembly between said platform and upper panel for supporting said platform as it rotates, said assembly including an annular frame, a plurality of ball bearing receptacles integral with said frame and arranged angularly about said frame, and means forming a bearing compartment in each of said receptacles, each compartment being symmetrical about a vertical bearing axis and including a top portion with a diameter less than the diameter of an associated ball bearing contained in said compartment, with the remainder of each compartment having a diameter greater than the diameter of said ball bearing; and a plurality of bearing retaining nodules angularly arranged about the bottom of said compartment and extended radially inward, said nodules normally preventing passage of said ball bearing into and out of said compartment, but elastically compressible to admit said ball bearing into and release said bearing from said compartment.

11. The apparatus of claim 10 wherein:

said top portion of said compartment includes an annular, upwardly and radially inwardly inclined bearing retaining surface.

12. The apparatus of claim 11 wherein: said housing is constructed of metal, and said apparatus includes a plurality of dielectric feet for supporting said lower panel in spaced apart relation to a floor of a microwave oven.

13. The apparatus of claim 12 further including:

a dielectric spacing means between said bearing assembly and said housing, with said bearings constructed of metal.

14. The apparatus of claim 13 wherein:

said spacing means comprises a substantially flat plastic disc having a diameter greater than an outside diameter of said frame, said disc concentric with said housing and having a central opening to accommodate said turntable shaft.

15. The apparatus of claim 14 further including:

means forming an annular ridge projected downwardly from the bottom of said platform, and having a diameter slightly less than the inside diameter of said frame, for retaining said frame in concentric relation to said platform.

* * * * *